US008161703B2

(12) United States Patent
Peeters

(10) Patent No.: US 8,161,703 B2
(45) Date of Patent: Apr. 24, 2012

(54) COMPRESSIBLE INSULATION ELEMENT WITH REDUCED FRICTION

(75) Inventor: Roger Peeters, Jx Heythuysen (NL)

(73) Assignee: Rockwool International A/S, Hedenhusene (DK)

( * ) Notice: Subject to any disclaimer, the term of this patent is extended or adjusted under 35 U.S.C. 154(b) by 71 days.

(21) Appl. No.: 12/526,745

(22) PCT Filed: Feb. 8, 2008

(86) PCT No.: PCT/EP2008/051565

§ 371 (c)(1), (2), (4) Date: Feb. 26, 2010

(87) PCT Pub. No.: WO2008/098884

PCT Pub. Date: Aug. 21, 2008

(65) Prior Publication Data

US 2010/0146896 A1 Jun. 17, 2010

(30) Foreign Application Priority Data

Feb. 12, 2007 (EP) ..... 07388007

(51) Int. Cl.
*E04B 1/74* (2006.01)

(52) U.S. Cl. ..... 52/406.2; 52/741.1

(58) Field of Classification Search ..... 52/406.2, 52/741.1, 407.1, 407.2; 428/68, 71
See application file for complete search history.

(56) References Cited

U.S. PATENT DOCUMENTS

| | | | | |
|---|---|---|---|---|
| 2,913,104 | A | 11/1959 | Parker | |
| 3,835,604 | A * | 9/1974 | Hoffmann, Jr. | 52/105 |
| 3,955,031 | A * | 5/1976 | Jones et al. | 442/412 |
| 5,362,539 | A | 11/1994 | Hall et al. | |
| 5,759,659 | A * | 6/1998 | Sanocki et al. | 428/74 |
| 5,765,318 | A * | 6/1998 | Michelsen | 52/98 |
| 6,128,884 | A * | 10/2000 | Berdan et al. | 52/742.12 |
| 6,141,930 | A | 11/2000 | Allwein et al. | |
| 6,191,057 | B1 | 2/2001 | Patel et al. | |
| 6,221,464 | B1 * | 4/2001 | Patel et al. | 428/192 |
| 6,534,144 | B1 * | 3/2003 | Bando et al. | 428/74 |
| 6,579,586 | B1 | 6/2003 | Fay et al. | |
| 6,878,427 | B2 * | 4/2005 | Schmidt et al. | 428/71 |
| 7,282,252 | B2 * | 10/2007 | Fay et al. | 428/137 |
| 7,780,886 | B2 * | 8/2010 | Lembo | 264/113 |
| 2004/0088939 | A1 | 5/2004 | Fay et al. | |
| 2006/0053559 | A1 | 3/2006 | Vantilt et al. | |
| 2006/0201089 | A1 * | 9/2006 | Duncan et al. | 52/309.8 |

FOREIGN PATENT DOCUMENTS

| | | |
|---|---|---|
| DE | 31 36 935 C1 | 4/1983 |
| EP | 1 448 368 B1 | 3/2006 |
| GB | 1 362 321 | 8/1974 |
| WO | WO 94/29540 | 12/1994 |
| WO | WO 97/08401 | 3/1997 |
| WO | WO 2005/094443 A2 | 10/2005 |

* cited by examiner

*Primary Examiner* — Robert J Canfield
*Assistant Examiner* — Brent W Herring
(74) *Attorney, Agent, or Firm* — Finnegan, Henderson, Farabow, Garrett & Dunner LLP

(57) ABSTRACT

A compressible mineral fiber insulation element (1) having a first major surface (3) opposed to a second major surface (4), and having side surfaces (5) connecting the two major surfaces (3, 4) and defining a thickness of the insulation element (1). The thickness is at least 10 cm. The insulation element comprises a facing (20) provided with at least one extension flange (21) of which the outer end (22) is not secured to the insulation element. The facing (20) is attached to at least a part of the first major surface (3), and the extension flange (21) is prepared for extending over and covering a substantial part of the side surface (5) of the insulation element (1). A method of installing a compressible insulation element is also disclosed.

11 Claims, 3 Drawing Sheets

COMPRESSIBLE INSULATION ELEMENT WITH REDUCED FRICTION

This invention concerns an insulating product comprising a compressible mineral fibre insulation element having a first major surface opposed to a second major surface, and having side surfaces connecting the two major surfaces and defining a thickness of the insulation element, said thickness being at least 10 cm, said product comprising a second facing on said second major surface of said insulation element which is provided with flanges extending beyond said second major surface, and prepared for being used for attachment of the insulation product.

The invention further concerns a method of installing an insulation product.

BACKGROUND

The strong desire in reducing the consumption of energy for heating and cooling of buildings has lead to many different and specialized insulation materials and techniques, and the prior art holds a countless number of specialized products and techniques, e.g.:

- US 2004/0088939 A1, which teaches a facing of a faced insulation layer having Z-folded, double-folded, or single-folded lateral tabs extending the length of the facing sheet along or spaced inwardly from lateral edges of the facing sheet. One of the segments of each lateral tab has an adhesive thereon that can be exposed and extended beyond one of the lateral edges of the insulation layer for bonding the faced insulation layer to a framing member.
- DE 3136935 C1, which teaches an insulation web incorporating for heat and sound insulation of buildings, in particular building roofs and external walls. The subject matter of the document is that the mineral wool is always formed within the web or panel from successive, mutually overlapping layers and in which the mineral fibres are ordered essentially parallel to the layer surfaces. The document also discloses a web including a vapour barrier intended to be mechanically secured to building elements.
- U.S. Pat. No. 6,579,586 B1, which teaches a fibrous insulation batt encapsulated within an envelope to form an encapsulated insulation batt assembly. The envelope has pressure sensitive adhesive on lateral flanges or surfaces of the envelope for securing the encapsulated insulation batt assembly to spaced-apart frame members of buildings. Release liners, on surfaces of the envelope or the lateral flanges, which overlay and are releasable secured to the pressure sensitive adhesive, are removed from the pressure sensitive adhesive immediately prior to bonding the encapsulated insulation batt assembly to the spaced-apart frame members. Preferably, the release liners for the pressure sensitive adhesive are contact areas on the surfaces of the envelope or the lateral flanges coated or otherwise treated with a release agent.
- U.S. Pat. No. 2,913,104 A1, which teaches encased insulation blankets with outwardly extending flanges intended to be mechanically secured to building elements, e.g. via nails or staples.
- U.S. Pat. No. 5,362,539 A, which teaches a mineral fibre insulation assembly wherein the assembly includes a longitudinally extending mineral fibre core having opposed major surfaces, opposed side surfaces and opposed end surfaces. A low friction polymer film is positioned adjacent the major surfaces and the side surfaces. At least one of the side surfaces is attached to the polymer film. A plurality of openings are provided in the polymer film adjacent at least one of the side surfaces. The insulation assembly is readily compressible and expandable at the job site. The low friction film provides easy installation, however the low friction polymer film is glued to the core of the assembly.

The focus on saving use of energy for heating and cooling of buildings has lead to the use of increasing thickness of the insulation layer. When insulating roofs, insulation is often arranged between rafters where it is important with a close fitting to the rafters in order to obtain the best insulation performance.

The present invention is based on the acknowledgement of a problem when installing such thick insulation between rafters. The problem arises when this thick insulation is also compressible e.g. for reasons of providing the cheapest possible transport from factory to building site. When unpacked at the building site the insulation will expand to the thickness it must have when installed.

It has been found that, when installing this insulation between beams or rafters, air gaps are formed which are not directly visible for the installer. These air gaps are extending along the direction of the rafters.

These air gaps are formed on the side opposite the side from which the insulation is installed, and are therefore not easily detected, or not realised during installation, to some extend because the installation of the insulation is performed as a task based contract resulting in a high speed of the work. However, such air gaps will considerably reduce the performance of the insulation and will result in higher costs for heating or cooling the building.

It has now been found that the cause of these air gaps is that the thick insulation will still be easily compressible when being installed and therefore the friction between the insulation material and the surface of the rafters will make it difficult to push the insulation material all the way into the correct position along the surface of the beams or rafters without the insulation being deformed. This leads to the formation of air gaps extending along the direction of the rafters.

None of the above cited documents realizes this disadvantage, and the objective of the invention has therefore been to find a solution to this new acknowledged problem of avoiding these air gaps without reducing the thickness or the compressibility of the insulation and without increasing installation time.

THE INVENTION

The problem has been solved by an insulating product that further comprises a first facing which is attached to at least a part of said first major surface and which is provided with at least one extension flange having an outer end and where said outer end is not secured to said insulation element and where the outer surface of said extension flange has a coefficient of friction in relation to a wood surface which is smaller than the coefficient of friction of a side surface of the mineral fibre insulation in relation to the same wood surface.

By applying this facing it is possible to obtain a frictional force when installing the insulation element between (especially wooden) beams or rafters, which is smaller than the force needed for substantial deformation of the insulation material in the direction of its thickness. Such deformation would typically result in the formation of air gaps.

By extending the facing over a substantial part, preferably more than half of the thickness of the insulation element, it has been found that also easily compressible and relatively thick insulation elements, at least 10 cm, can be introduced in between beams or rafters without creating the above mentioned air gaps. This is due to the lower friction against the beam or rafter, which is often made from wood with a rough surface.

In general, friction is the force that opposes the relative motion or tendency of such motion of two surfaces in contact. The coefficient of friction (also known as the frictional coefficient) is a dimensionless scalar value which describes the ratio of the force of friction between two bodies and the force pressing them together. The coefficient of friction depends on the two materials involved.

The insulation element of the invention has the advantage that the facing covering a substantial part of, and preferably more than half, the thickness of the insulation element on the at least one side surface has a coefficient of friction in relation to a wood surface which is lower than the coefficient of friction between the side surface of a mineral fibre surface and a wood surface. The wood surfaces in question are often rough, and typically unfinished. The friction is unavoidable since the distance between two neighbouring rafters must be completely filled with insulation material in order to obtain sufficient insulating properties. Therefore, the insulation element must fill up the whole distance between rafters.

The insulation elements of the invention may have the form of rolls and slabs.

By the term compressible is meant that the insulation element may, by applying a compression force, be compressed to a thickness of 70% of the original thickness, preferably 60%, more preferably 50%, and even more preferably 40% or less of the original thickness, and when the compression force is removed the insulation element will re-expand to the original thickness or substantially the original thickness.

In a preferred embodiment, the extension flanges of the facing is extending over two opposed side surfaces, which makes installation easier. Preferably, at least one extension flange is prepared for extending over more than 50%, i.e. half, of the side surface of the insulation element, preferably over at least 75%, i.e. three quarters, of the side surface of the insulation element, and even more preferably, at least one extension flange is prepared for extending over the whole or substantially the whole side surface of the insulation element. The larger a part of the surface covered by the facing the lower friction is obtained.

The insulation element, either roll or slab, is being covered on both of the two major surfaces by a facing.

The facing on the first major surface will have extending flanges over at least one side surface for the purpose described above.

The facing on the second major surface will be useful for the formation of a vapour barrier, and the extensions or flanges of this second facing can be used for fastening the insulation element to beams or rafters.

One advantage of having facings on both major surfaces is the reduction of the direct contact with the fibrous surfaces when persons are installing the insulation. Furthermore the release of fibres to the air, when handling the insulation elements, is reduced when a larger part of the surfaces is having a facing. These two advantages can be achieved without sacrificing the advantage of the insulation element according to the invention, i.e. that the insulation element is easily compressible for transport purposes, since no facing is attached to the major part of each of the side surfaces.

Both facings are attached, e.g. by gluing, to the major surfaces of the mineral fibre insulation element, while no facings is attached to the majority of the area of the sides of the insulation element. The facing on the first major surface will always extend over the side surfaces of the insulation element.

If the facing on the second major surface extends over the side surfaces the length of this extension will usually be in the range 4-5 cm, however it could be higher, e.g. up to 10 cm or even 15 cm, and this extension is for mounting reasons e.g. by nailing.

The at least one extension, which is arranged on the facing of the second surface, and the at least one extension flange of the facing arranged on the first surface will have free ends meaning that the extension and the flange are not joined.

The facing on the first major surface can be extending as wide as the thickness of the insulation element itself, and will at least extend over half the thickness. These extension flanges are for reducing friction between the insulation material (usually mineral fibres) and the rafters or wooden frame.

Furthermore, both facings may be used for any type of graphics, e.g. for branding, or for markings helping for mounting, fixing or cutting.

The invention also concerns a method of installing a compressible insulation product between a pair of beams or rafters comprising the steps of:

providing a compressible mineral fibre insulation element having a first major surface opposed to a second major surface, and having side surfaces connecting the two major surfaces and defining a thickness of the insulation element, said insulation element comprises a facing having a surface with a coefficient of friction in relation to a wood surface which is smaller than the coefficient of friction of a side surface of the mineral fibre insulation in relation to the same wood surface, and wherein the facing is provided with at least one extension flange of which the outer end is not secured to the insulation element, said facing being attached to at least a part of the first major surface and said extension flange of the facing is prepared for extending over and covering at least a part of the area of at least one side surface;

covering a part of at least one side surface by said extension flange with said outer end being on said side surface; and introducing the insulation element in between a pair of beams or rafters with said first major surface with the facing entering first.

Preferably this method also comprises the step of unpacking the insulation element and letting it expand to the non compressed thickness.

Preferably the insulation element is attached to the beams or rafters by the use of a further second facing attached to the second major surface of the insulation element; said second facing having flanges extending beyond the area of the second major surface, and said flanges being used for attachment of the insulation element as already described above.

BRIEF DESCRIPTION OF THE DRAWINGS

Different embodiments of the invention will now be described in further details with reference to the figures, where.

DETAILED DESCRIPTION OF THE INVENTION

Figure 1:
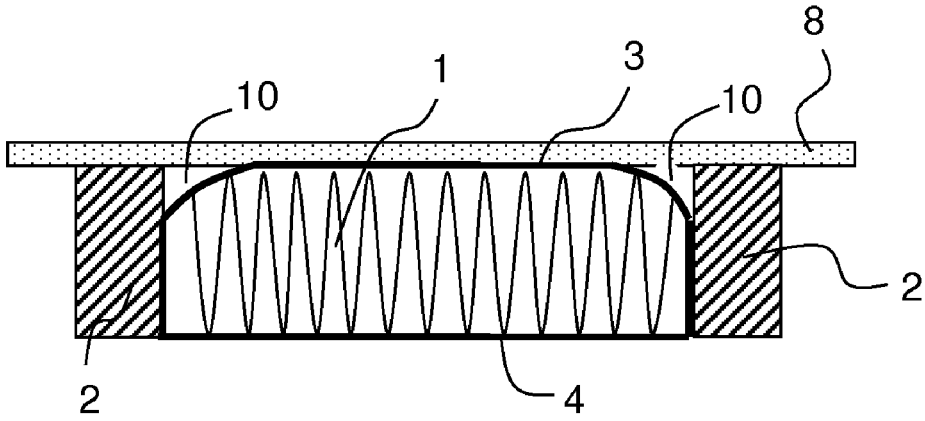
Fig. 1 (Prior art)
FIG. 1 illustrates the acknowledged problem with some prior art solutions.

FIG. 1 shows the problem with a known thick and compressible insulation element 1 having been installed between beams or rafters 2, where the insulation have been compressed such that air gaps 10 are formed. The wall or ceiling part 8 is the surface against which the insulation element 1 is pushed when introduced between the beams or rafters 2, with the first major surface 3 first.

Figure 2:
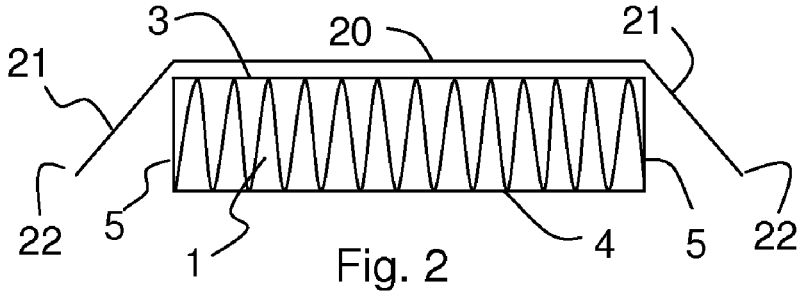
FIG. 2 illustrates a cross sectional view of insulation element with a facing extending over two side surfaces of the insulation product.

FIG. 2 shows an embodiment of a product for use in the method of the invention, where a facing 20 is secured to one major surface 3, i.e. the first major surface, of the insulation element 1 and is extending over two opposite side surfaces 5. The air gap between the facing 20 and the major surface 3 is obviously out of scale on the illustration. This air gap will in practice be almost non existent and more or less filled with glue or adhesive. The parts of the facing 20 extending over the side surfaces 5 are illustrated as not being connected to these, as they are not parallel with the side surfaces 5. These parts, i.e. the flanges 21 of the facing 20, are often of a rectangular shape, so that the extension flange 21 will extend over the same distance in the thickness direction, over the whole side surface. However, the invention will also function if the distance in the thickness direction varies, i.e. if the shape of the extension flange 21 is not rectangular.

For the embodiment illustrated in FIG. 2 and also for the embodiments described below it applies that the insulation element 1 may be in the form of a roll or in the form of a slab. If the insulation element 1 is a roll its density will be in the range 10-30 kg/m$^3$, preferably 18-28 kg/m$^3$, and even more preferably approximately 23 kg/m$^3$, however the density could be higher, e.g. up to 40 kg/m$^3$. If the insulation element is a slab, the density will be in the range 20-60 kg/m$^3$, preferably 34-55 kg/m$^3$, and even more preferably the density will have a value around 34 kg/m$^3$, 43 kg/m$^3$ or 55 kg/m$^3$.

When the insulation element has the form of rolls, they may, in preferred embodiments, be produced in various widths, such as 35 cm, 45 cm, 60 cm or 100 cm. The length of the rolls is less relevant. When the insulation element is a slab it may be produced in various widths, such as 50-70 cm and various lengths, such as 90-130 cm, preferably the slabs are produced in standard dimensions, such as 60×100 cm and 60×120 cm. The thicknesses for both rolls and slab will be at least 10 cm, preferably more than 15 cm, more preferably more than 20 cm, and even more preferably at least 30 cm. The thickness may even be up to 40 cm or 50 cm. When slabs are produced for wooden frames the width may be in the range 38 cm and 58 cm. In this case the slab may be provided with one or more flexible sides, i.e. a side where the fibre structure has been crushed such that compression of the slab, in order to make it fit between rafters, is possible. Such one or more flexible sides will obviously lead to a higher compression force of the side surface 5 of the insulation element 1 against the surface of the beam or rafter 2, also when introducing the insulation element 1 between two rafters. Thereby the friction will also be increased.

The facing 20 often covers a major part of the first major surface 3 of the insulation element 1. The facing 20, 21 could be a facing of paper, fleece (e.g. glass fibre fleece), aluminium, aluminium paper, plastic film, water vapour barrier or a membrane, etc. This facing may be glued with PE on the backside and heat sealed or glued with a binder solution as traditionally used for gluing glass fleece to a slab. Other options could be water glass or other liquid glues.

Figure 3:
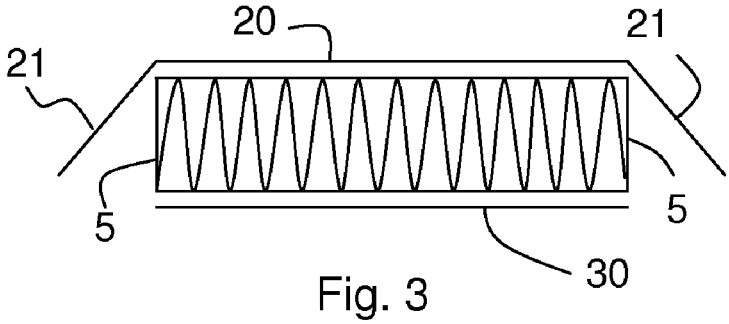
FIG. 3 illustrates an insulation element with a facing extending over two side surfaces and one further facing covering a major surface.

FIG. 3 shows an embodiment for use in the method of the invention also provided with a second facing 30 attached to the second major surface 4 of the insulation element. The second facing 30 may function as a vapour barrier when the insulation element has been installed, and will then be of a material with a low vapour diffusion coefficient.

Figure 4:
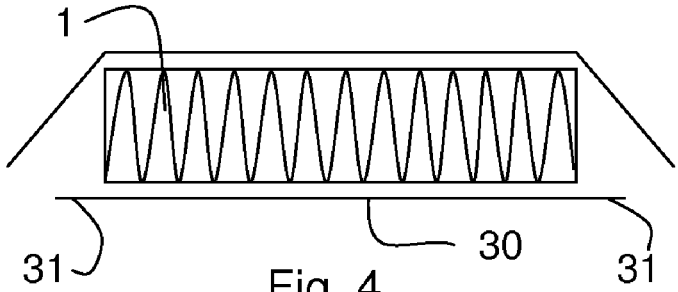
FIG. 4 illustrates an insulation element with a facing extending over two side surfaces and one further facing covering a major surface having sides extending the insulation product for mounting/fixing the insulation product.

In FIG. 4 the second facing 30 is extending over the area of the second major surface 4. These extending parts, also a kind of flanges 31, are typically applied for fastening the insulation element 1 to the rafters between which it is arranged. This second facing 30 with its extending flanges 31 is known from a so-called wing mat, where the wings are the part or flanges 31 of the second facing 30 extending over the area of the second major surface 4. For both the embodiment in FIG. 3 and in FIG. 4 the second facing 30, 31 of the installed insulation elements will be taped together during or after installation in order to obtain an airtight vapour barrier. The combination of the first 20, 21 and the second 30, 31 facings gives some further advantageous as described above.

This embodiment of FIG. 4 is usually applied for rolls, where the second facing 30 is often of aluminium and the extensions 31 will typically extend 4.5 cm over the second major surface 4. The second facing 30 is attached to the major surface 4 of the insulation element by the use of glue or adhesive. One possibility is to apply a PE glue, with approximately 20 grams/m$^2$, which is then heat sealed to the surface of the mineral fibre insulation by a heat drum.

When the insulation element 1 is in the form of a slab it will usually be faced with glass fleece or aluminium paper.

Figure 5:
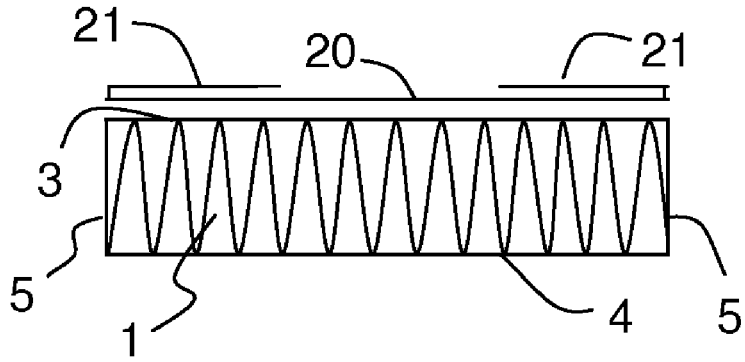
FIG. 5 illustrates the embodiment of FIG. 2 with the extending flanges of the facing bended around and placed on the rest of the facing.

FIG. 5 shows an embodiment where the extending flanges 21 of the facing 20 are bended around and placed along the rest of the facing 20. The facing 20 could be delivered to the manufacturing site of the insulation element 1 folded in this way, and attached to the insulation element with this folding. One advantage of this folding is that the extending flanges 21 are held in a position where they are protected during transport and unpacking.

Figure 6:
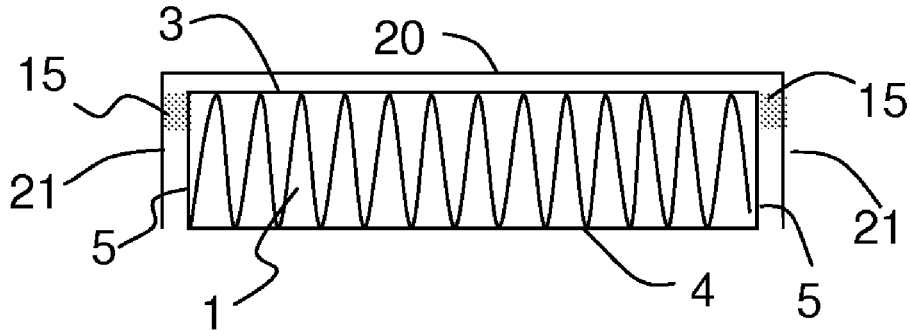
FIG. 6 illustrates an embodiment where the extension flanges of the facing are secured to a minor part of the side surface.

FIG. 6 shows an embodiment where the extension flanges 21 of the facing 20 are secured to a minor part of the side surface 5 in one or more zones 15 along the edge between the first major surface 3 and the side surface 5. By a minor part of the side surface is meant e.g. a narrow stripe of up to a few centimetres, e.g. 3 cm, along the corner, where the extending flanges 21 are e.g. glued to the side surface 5 of the insulation element 1 in this zone 15. The gluing could also be placed in limited areas of this zone 15 with intermediate non glued areas.

Figure 7:
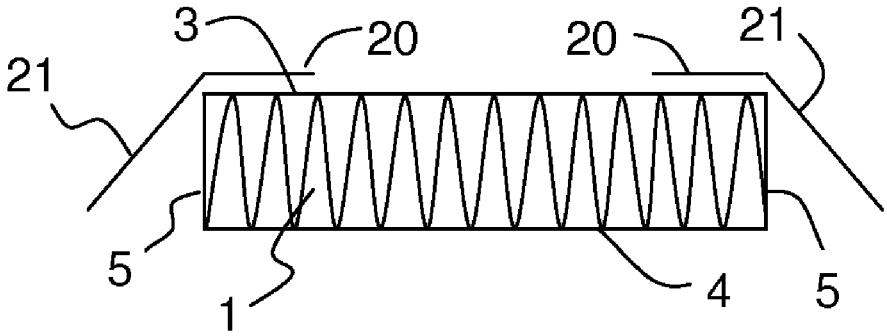
FIG. 7 illustrates an embodiment where the facing is only covering and attached to a part of the first major surface of the insulation element.

FIG. 7 shows an embodiment where the facing 20 only covers a part of the first major surface 3 of the insulation panel 1. This embodiment will save on the amount of facing material needed, and could be advantageous in constructions where a facing on the first major surface 3 of the insulation element is not needed.

The arrangement of the facing 20 shown in FIGS. 5-7 may of course be used in an insulating product which is also provided with a second facing 30 as shown in FIGS. 3 and 4.

Figure 8:
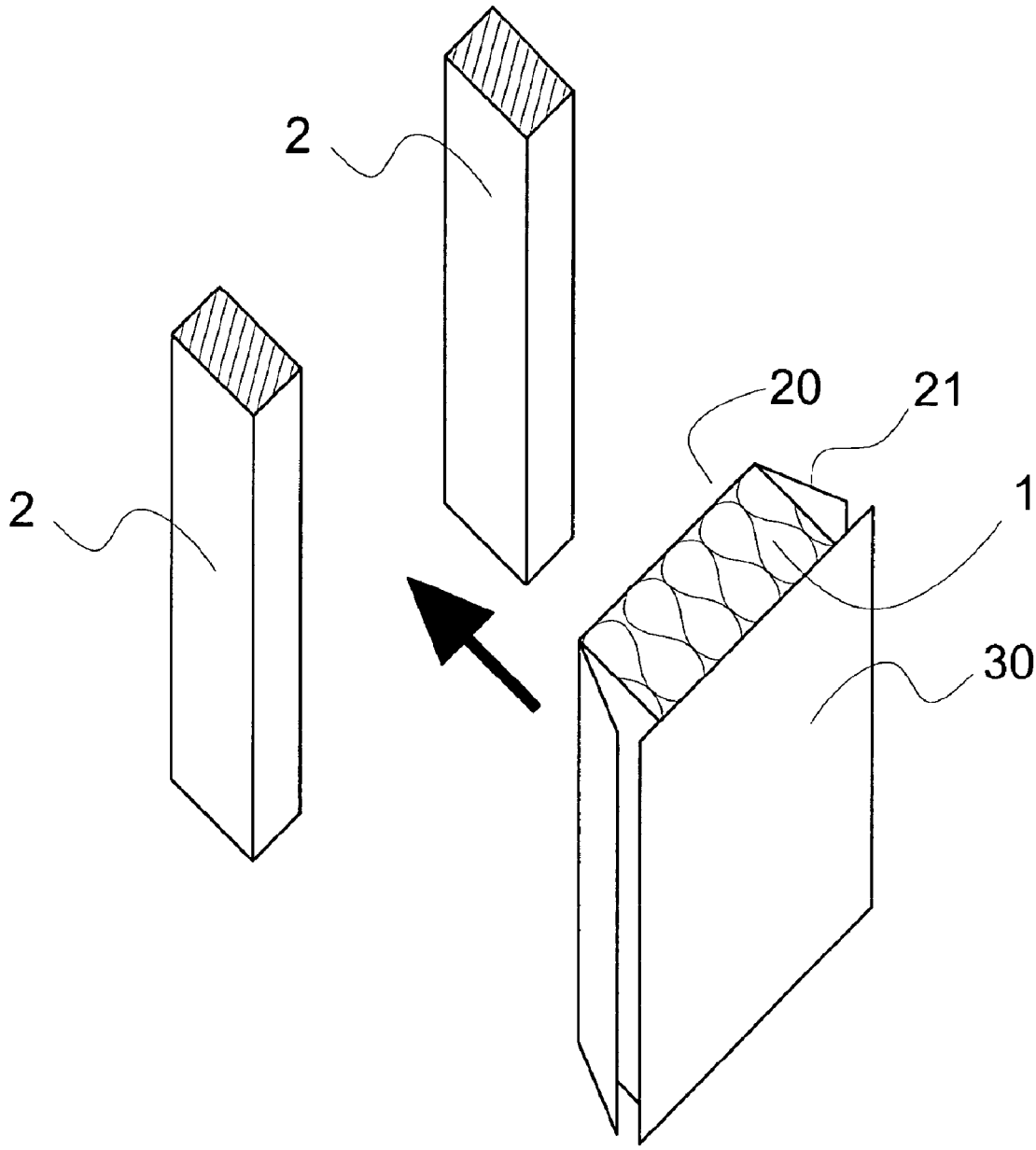
FIG. 8 illustrates part of the method of installing an insulation element according to one embodiment of the invention between rafters.

FIG. 8 shows how an insulation element 1 according to one embodiment of the invention may be installed between rafters 2. The extending flanges 21 of the facing 20 must be arranged such that they will be pressed against the side surfaces 5 of the insulation element 1 when introduced between the rafters. The facing 20 must be introduced first.

The invention claimed is:

1. An insulation product comprising a compressible mineral fiber insulation element having a first major surface opposed to a second major surface, and having side surfaces connecting the first and second major surfaces and defining a thickness of the insulation element, said thickness being at least 10 cm, said product having a first facing which is attached to at least a part of said first major surface and which is provided with at least one extension flange having an outer end and where said outer end is not directly secured to said insulation element and where an outer surface of said extension flange has a coefficient of friction in relation to a wood surface which is smaller than a coefficient of friction of a side surface of the mineral fiber insulation in relation to the same wood surface, said product having a second facing on said second major surface of said insulation element which is provided with flanges extending beyond said second major surface, and prepared for being used for attachment of the insulation product, wherein neither said first facing or said second facing is directly attached to a major part of each of the side surfaces of the insulation element, and said at least one extension flange and said flanges of said second facing are not directly joined.

2. The insulation product according to claim 1, including two extension flanges extending over two opposed side surfaces of the insulating element.

3. The insulation product according to claim 1 or 2, wherein at least one extension flange extends over more than 50% of a side surface of the insulation element.

4. The insulation product according to claim 1, wherein the thickness of said insulation element is more than 15 cm.

5. The insulation product according to claim 1, wherein said at least one extension flange is not secured to a side surface.

6. The insulation product according claim 1, wherein said at least one extension flange is secured to a minor part of one side surface in one or more zones along an edge between said first major surface and said one side surface.

7. The insulation product according to claim 1, wherein said first facing covers a major part of said first major surface of said insulation element.

8. The insulation product according to claim 1, wherein said first and second facings are selected from the group consisting of paper, fleece, aluminium paper, aluminium foil, and plastic film.

9. A method of installing an insulation product comprising a compressible insulation element between a pair of beams or rafters, comprising the steps of:

providing a compressible mineral fiber insulation element having a first major surface opposed to a second major surface, and having side surfaces connecting the first and second major surfaces and defining a thickness of the insulation element, said thickness being at least 10 cm, said insulation element having a first facing which is attached to at least a part of said first major surface and which is provided with at least one extension flange having an outer end and where said outer end is not directly secured to said insulation element and where an outer surface of said extension flange has a coefficient of friction in relation to a wood surface which is smaller than a coefficient of friction of a side surface of the mineral fiber insulation in relation to the same wood surface, a second facing on said second major surface of said insulation element which is provided with flanges extending beyond said second major surface, wherein neither said first facing or said second facing is directly attached to a major part of each of the side surfaces of the insulation element and said extension flange and said flanges of said second facing are not directly joined;

covering at least a part of at least one side surface with said extension flange with said outer end thereof being on said at least one side surface; and introducing the insulation element in between a pair of beams or rafters with said first major surface with the first facing attached thereto entering first.

10. The method of installing an insulation product according to claim 9, wherein said method also comprises the step of first unpacking a compressed insulation element and letting it expand to a non compressed thickness.

11. The method of installing an insulation product according to claim 9 or 10, wherein said insulation product is attached to the beams or rafters with said second facing on said second major surface of the insulation element, said flanges of the second facing being used for attachment of the insulation product.

* * * * *